US005739758A

United States Patent [19]

Driska et al.

[11] Patent Number: 5,739,758

[45] Date of Patent: Apr. 14, 1998

[54] SOUND GENERATING DRINKING CONTAINER

[75] Inventors: John Driska, Princeton Junction, N.J.; Elliott Azrak, New York, N.Y.

[73] Assignee: Funomenon LLC, New York, N.Y.

[21] Appl. No.: 709,513

[22] Filed: Sep. 6, 1996

[51] Int. Cl.[6] ..... G08B 25/08

[52] U.S. Cl. ..... 340/692; 340/384.1; 215/235; 220/263; 220/335; 220/703; 220/710.5; 220/711; 220/715; 220/756

[58] Field of Search ..... 340/692, 691, 340/384.1, 396.1, 391.1; 215/235; 220/263, 335, 343, 703, 710.5, 711, 715, 756; 116/307

[56] References Cited

U.S. PATENT DOCUMENTS

| | | | |
|---|---|---|---|
| 4,165,013 | 8/1979 | Lutz | 220/215 |
| 4,555,034 | 11/1985 | Gerhards | 215/100 R |
| 4,735,333 | 4/1988 | Lay et al. | 220/90.2 |
| 4,898,297 | 2/1990 | Wheeler | 220/85 H |
| 4,927,047 | 5/1990 | Stuber et al. | 220/903 |
| 5,070,539 | 12/1991 | Cheng | 455/344 |
| 5,130,696 | 7/1992 | Liebman | 340/692 |
| 5,435,787 | 7/1995 | Ratcliffe | 472/56 |
| 5,464,092 | 11/1995 | Seeley | 206/217 |
| 5,484,081 | 1/1996 | Jahn | 220/759 |
| 5,487,502 | 1/1996 | Liao | 239/69 |
| 5,518,142 | 5/1996 | Lin | 220/707 |
| 5,536,196 | 7/1996 | Sternberg | 215/400 |

*Primary Examiner*—Jeffery Hofsass
*Assistant Examiner*—Sihong Huang
*Attorney, Agent, or Firm*—Amster, Rothstein & Ebenstein

[57] ABSTRACT

A drinking container includes a fluid-tight container having a continuous sidewall connecting an open top and a closed bottom, and a handle secured to the sidewall and extending substantially the length thereof. A rigid lid has a lid body configured and dimensioned to close the open top and a lid lever extending outwardly from the lid body and beyond the handle for pivoting the lid body relative to the open top from a top-closed orientation to a top-open orientation. A pivot is secured to the handle for pivotally engaging the lid lever and enabling pivoting of the lid body between the top-closed orientation and the top-open orientation. An electronic sound generating element is disposed in the lid body and responsive to an actuating switch disposed on the lid lever such that the normal movement of a user for causing pivoting of the lid body from the top-closed orientation to the top-open orientation also actuates the sound-generating element prior to causing pivoting of the lid body. Preferably the lid and the sound-generating element are removable from the container and the pivot thereby to permit cleaning of the latter.

13 Claims, 4 Drawing Sheets

FIG. 4
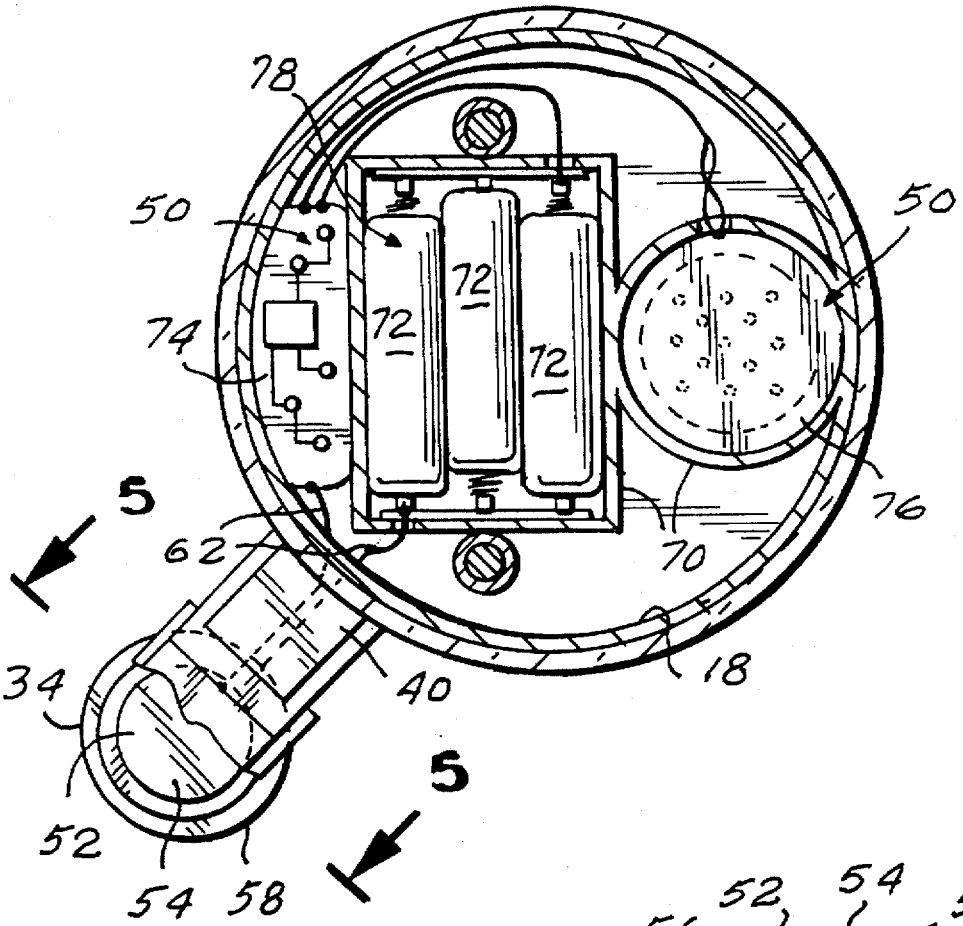
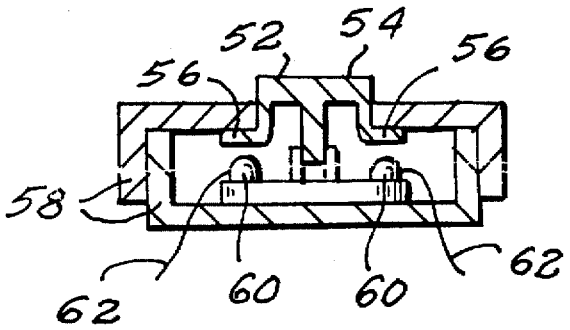
FIG. 5

SOUND GENERATING DRINKING CONTAINER

BACKGROUND OF THE INVENTION

The present invention relates to a drinking container having a pivotable cover and, more particularly, to such a container which is capable of generating sound.

As used herein and in the claims, the term "drinking container" refers to a mug, stein, or other beverage container having a pivotable lid so that a beverage may be temporarily stored therein with the lid down (for example, to minimize exposure of the beverage to ambient air) and drunk therefrom when the lid is raised. Such a drinking container may be used to store and dispense any beverage although it is classically associated with beer, as in a beer mug. Exposure of chilled carbonated beverages (such as beer) to ambient atmosphere can reduce the carbonation level and result in loss of the heat or chill of the beverage. Additionally, in some instances, there may be an undesirable chemical reaction between the oxygen in the ambient air and the beverage (for example, with wines).

In order to add interest to the conventional drinking container, they have been created in the configuration of characters, faces, various objects and the like. However, the interest and the excitement created by such a static configuration is somewhat limited, and there remains a need for a drinking container which peaks the interest of the user, especially one which would encourage the user to repeatedly open the top and, presumably, partake of the beverage in the container.

Accordingly, an object of the present invention is to provide a drinking container which is exciting to use and encourages drinking therefrom.

Another object is to provide such a drinking container which automatically generates sound when the user moves the top to the open orientation.

A further object is to provide such a container wherein, in a preferred embodiment, a representation of a character is secured to the top for movement therewith and appears to generate sound whenever the top is moved to the open orientation.

It is another object to provide such a container wherein, in a preferred embodiment, the sound may be generated without movement of the top to the open orientation.

It is another object to provide such a container which is stable and won't topple even when it is empty and the top is in the open orientation.

SUMMARY OF THE INVENTION

It has now been found that the above and the related objects of the present invention are obtained in a drinking container which can generate sound. The drinking container comprises a fluid-tight container having an open top, a closed bottom, a continuous sidewall connecting the top and bottom, and a handle secured to the sidewall and extending substantially the length of the sidewall. A rigid lid has a lid body configured and dimensioned to close the open top and a lid lever extending outwardly from the lid body and beyond the handle for pivoting the lid body relative to the open top from a top-closed orientation to a top-open orientation. Means pivotally secure together the handle and the lid lever so as to enable pivoting of the lid body between the top-closed orientation to the top-open orientation. An electronic sound-generating element is disposed in the lid body and responsive to an actuating switch disposed on the lid lever such that the normal movement of a user for causing pivoting of the lid body from the top-closed orientation to the top-open orientation also actuates the sound-generating element prior to causing pivoting of the lid body.

In a preferred embodiment, the lid body has a fluid-tight compartment housing a power source and the sound-generating element. The lid and the sound-generating element are removable from the container and the securing means, thereby to permit cleaning of the latter.

The lid lever has disposed therein an actuating switch extending upwardly therefrom for actuation of the sound-generating element, the actuating switch preferably being manually actuable without pivoting of the lid body from the top-closed orientation.

In an especially preferred embodiment, the container additionally includes a character secured to the top of the lid body for movement therewith. Preferably, the lid body houses an upwardly-facing speaker disposed adjacent the character and actuated by the sound-generating element. The container is crystal (high impact) polystyrene, the lid and the securing means are resilient acrylonitrile-butadiene-styrene (ABS), and the character is molded polyvinyl chloride (PVC).

Preferably, the handle defines an outrigger rest disposed in the same plane as the container bottom and outwardly beyond a vertical axis through the pivot axis of the lid relative to the securing means. The lid lever and the handle by abutment limit the top-open orientation to one in which the container, even when empty, will normally remain upright on the container bottom and the outrigger rest.

BRIEF DESCRIPTION OF THE DRAWING

The objects, features and advantages of the present invention will be more fully understood by reference to the following detailed description of the presently preferred, albeit illustrative, embodiments of the present invention when taken in conjunction with the accompanying drawing wherein:

FIGS. 4 and 5 are sectional views taken along the line 4—4 of FIG. 3 and the line 5—5 of FIG. 4, respectively.

DETAILED DESCRIPTION OF PREFERRED EMBODIMENTS

Figure 1:
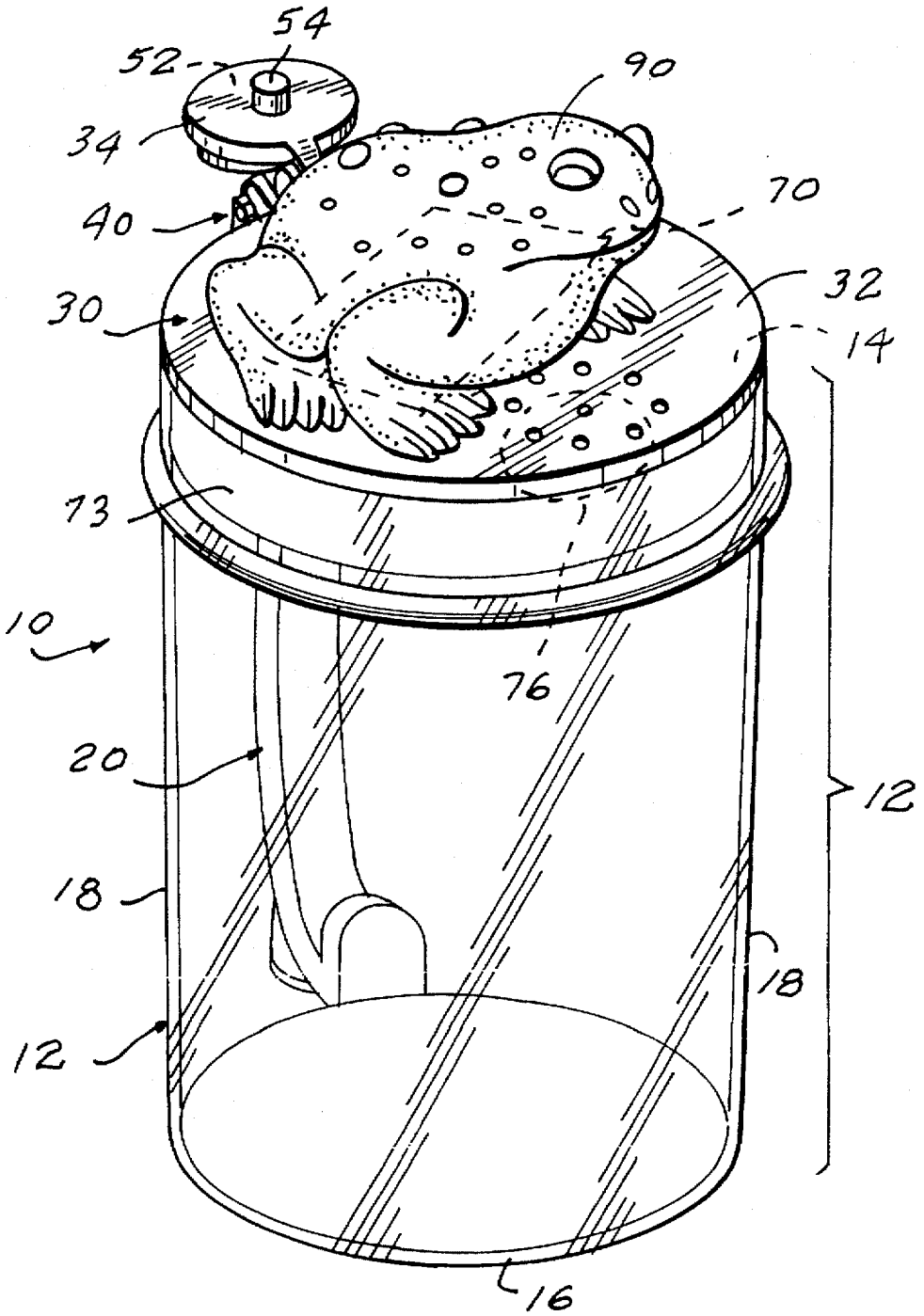
FIG. 1 is an isometric view of a beverage container according to the present invention.
Figure 2:
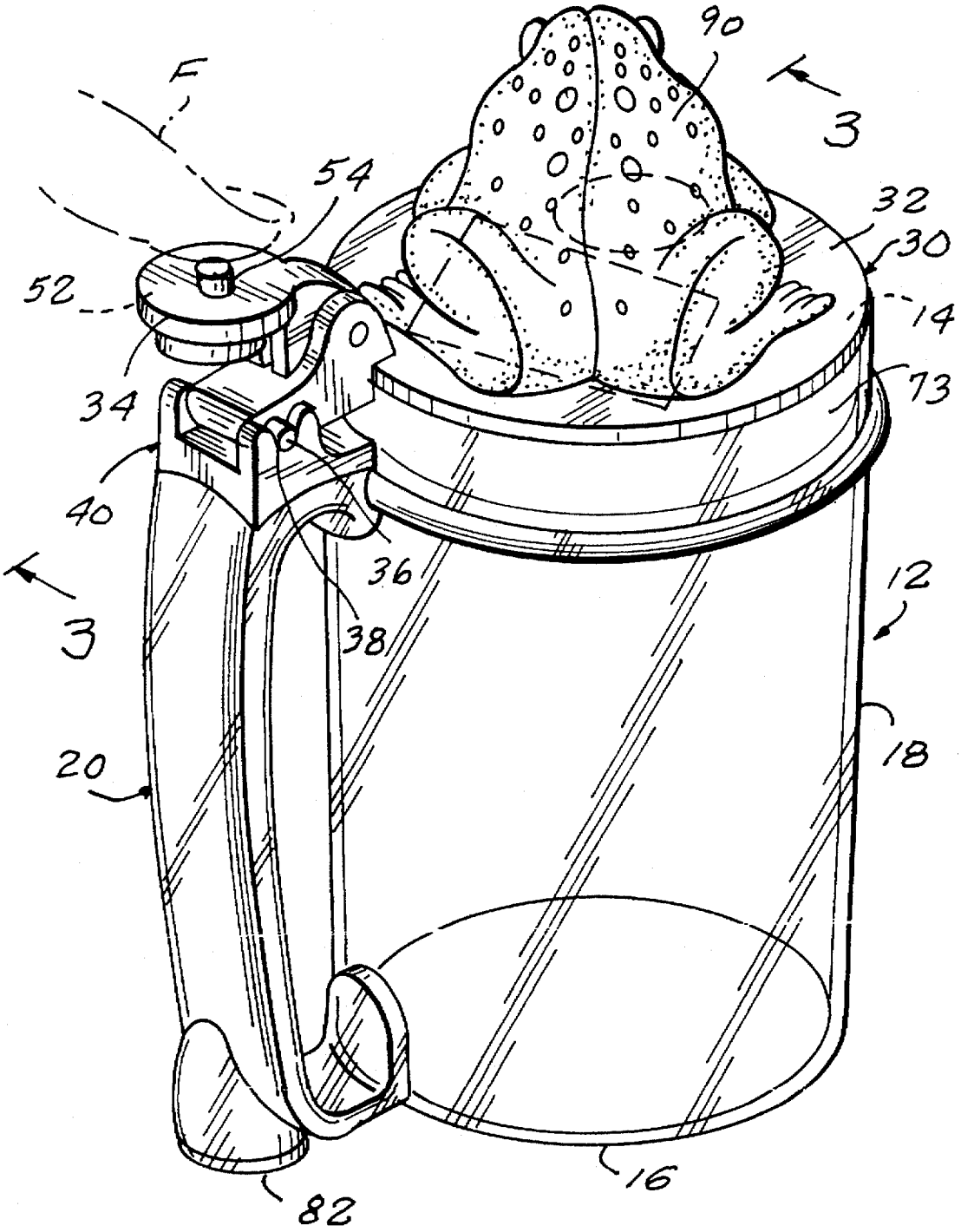
FIG. 2 is an isometric view thereof, with a finger illustrated in phantom line in a position for uncovering the container.

Referring now to the drawing, and in particular to FIGS. 1 and 2 thereof, therein illustrated is a drinking container according to the present invention, generally designated by the reference numeral 10.

In its conventional aspects the container 10 comprises a fluid-tight container, stein, or mug, generally designated 12, having an open top 14 (best seen in FIG. 3), a closed bottom 16, and a continuous sidewall 18 connecting the top 14 and bottom 16. A handle, generally designated 20 (best seen in FIG. 2 but also visible through the transparent mug 12 in FIG. 1) is secured to the sidewall 18 and has, a body extending substantially the length of the sidewall 18 from the open top 14 to the closed bottom 16. As is conventional in mug handles, the body of the handle is spaced from the sidewall 18 of the mug 12 sufficiently to enable to the user to conveniently grasp the handle 20.

While the mug 12 is illustrated as transparent, clearly it may be translucent, opaque, colored or decorated. Similarly, while the mug is illustrated as being of cylindrical configuration (closed at one end), the mug 12 may assume a variety of different configurations (e.g., polygonal) commonly used for mugs. The only caveat to be noted is that, for reasons to become apparent hereinafter, the placement of the center of gravity of the mug must be carefully considered to insure that it does not tip over when the lid is open.

The drinking container 10 additionally includes a rigid lid, generally designated 30, having a lid body 32 and a lid lever 34. The lid body 32 has an appreciable thickness and is configured and dimensioned to close the open top 14 of the mug 12 when the lid body 32 is in the top-closed orientation. A ring of resilient material (not shown) may be disposed on the periphery of an undersurface of the lid body so as to effect a tighter seal between the lid body 32 and the open top 14 when the lid body 32 is in the top-closed orientation. The lid lever 34 extends outwardly from the lid body 32 and beyond the handle 20 for pivoting the lid body 32 relative to the open top 14 of the mug 12 from a top-closed orientation (as illustrated in solid line in FIGS. 1–3) to a top-open orientation (as illustrated in phantom line in FIG. 3).

Figure 3:
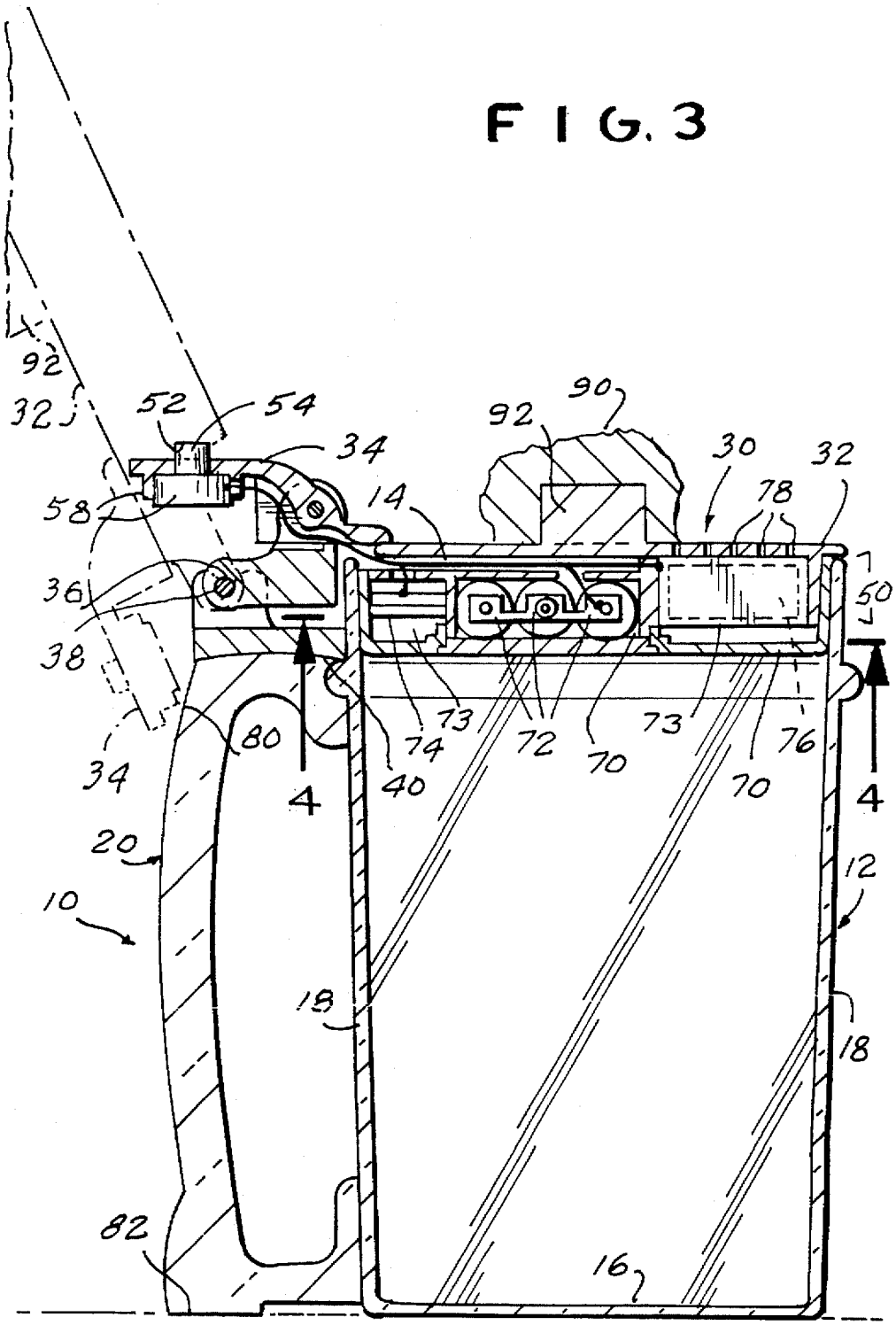
FIG. 3 is a fragmentary side elevational view thereof, with the top shown in the open orientation in the phantom line.

Means, generally designated 40, are provided for pivotally securing together the handle 20 (adjacent the top thereof) and the lid lever 34 (adjacent its connection to the lid body 32) so as to enable pivoting of the lid 30, and in particular pivoting of the lid body 32, between the top-closed orientation (illustrated in FIGS. 1 and 2) and the top-open orientation (illustrated in phantom line in FIG. 3). As best seen in FIG. 2, one of the lid lever 34 and the securing means 40 (here, the lid lever 34) defines a pivot shaft 36 and the other of the elements 34, 40 (here, the securing means 40) defines a recess 38 for releasably capturing the ends of the pivot shaft 36 and securing them to the handle 20. Preferably the securing means 40 defines the recess 38 and is made of a strongly resilient material, while the lid 30 (and in particular the lid lever 34) is rigid and defines the pivot shaft 36. The recess-defining means (here, the securing means 40) is preferably permanently secured to the top of the handle 20, for example, by adhesives, cement, screws, or the like.

In its conventional aspects, securing means 40 pivotally secures together the handle 20 and the lid lever 34 so as to enable pivoting of the lid body 32 between the top-closed orientation and the top-open orientation, but does not allow the lid 30 to be separated from the handle 20. Thus, the pivot shaft 36 is permanently disposed within the shaft-receiving recess 38. As means for pivotally securing together a mug and its lid as well known in the container art, it is not deemed necessary to set forth further details thereof herein.

Turning now to the novel aspects of the present invention, and referring now in particular to FIGS. 3–5, an electronic sound-generating element, generally designated 50, is disposed within the lid body 32. It will be appreciated that, for the purpose of the present invention, the lid body 32 is relatively deep (about ¾ inch) so that it can receive and maintain the necessary sound-generating element 50. The sound-generating element 50 is responsive to an actuating switch 52 disposed on an upper surface of the lid lever 34 such that (as illustrated in FIG. 2), the normal movement of a finger of the user (see the thumb F) for causing pivoting of the lid body 32 from the top-closed orientation to the top-open orientation also actuates the sound-generating element 50, preferably prior to causing pivoting of the lid body 32.

More particularly, the actuating switch 52 includes an upwardly projecting, upwardly biased actuating button 54 having two contacts 56 and a housing 58 containing two electrically separate contacts 60 vertically juxtaposed to contacts 56. Leads 62 from the sound-generating element 50 are connected to the contacts 60. Each contact 60 is electrically isolated under normal conditions, and the contacts 60 are electrically connected only when the actuating button 54 is depressed so that its electrically connected contacts 56 engage the contacts 60. As the contacts 56 are in conductive contact, they then close the circuit between the contacts 60, and hence the leads 62, thus actuating the electronic sound-generating element 50 within the lid body 32.

It will be appreciated that the normal movement of the user for causing pivoting of the lid body 32 from the top-closed orientation to the top-open orientation will also cause the actuating button 54 to close the circuit 62, thereby actuating the sound-generating element 50. It will further be appreciated that such actuation requires only the downward movement of the actuating button 54 and does not require any movement of the entire actuating switch 52, the lid lever 34 or the lid 30. Accordingly, in a preferred embodiment of the present invention, the user not only actuates the sound-generating element 50 as part of the normal movement of the user who wishes to take a drink (and must therefore pivot the lid body 32 to an open orientation) but also has the option of actuating the sound-generating element 50 even when he does not wish to take a drink, and even when he does not wish to uncover the beverage in the mug 12. This, is because a limited depression of the actuating button 54 actuates the sound-generating element 50 without causing pivoting of the lid body 32.

In a departure from the conventional aspects of a drinking container, in the present invention the lid 30 and sound-generating element 50 are removable from the mug or container 12 and the securing means 40, thereby to permit cleaning of the latter without danger of wetting the moisture-sensitive electronics (such as the sound-generating element 50) within the lid 30 (and in particular the lid body 32). For example, the lid body 32 will typically include a user-accessible fluid-tight, compartment 70 housing a replaceable power source 72 (such as 3 AAA batteries) a sound-generating chip 74 and an upwardly-facing speaker 76, all as part of or actuated by the sound-generating element 50. Sound-generating chips of the type used for the present invention are well-known in the sound-generating art and need not be set forth herein in further detail.

The top surface of the lid body 32 (defining a portion of compartment 73) is preferably provided with a plurality of small holes 78 disposed above the loudspeaker 76 so that the sound produced by the sound-generating element 50 emerges from the loudspeaker 76 of the container 10 through the small apertures 78. While the lid 30 is easily removable from the mug 12 and securing means 40, so as to enable easy dishwasher washing of the mug 12 and securing means 40, the lid 30 may be carefully handwashed with due care being taken to preclude the entry of water into the compartment 73 through the small apertures 78 above the loudspeaker 76.

The introduction of the sound-generating element 50 (including the power supply 72, the loudspeaker 76, and the sound chip 74) into the body 32 of pivotal lid 30 can make the balance of the overall container 10 quite unstable such that the container 10 is likely to tip over when the lid 30 is in the top-open orientation, especially if the mug 12 is empty. This issue of balance may be dealt with simply by configuring and dimensioning the lid lever 34 and the handle 20 such that they, by abutment, limit the top-open orientation to an orientation in which the container 10, even when empty, will normally remain upright on the container bottom 16. In other words, as illustrated in FIG. 3, the lid lever 34 in the top-open orientation (illustrated in phantom line) will abut the handle 20 of mug 12 at point 80. The location of point 80 must, of course, be determined as a compromise by the product designer such that it both enables the beverage to be comfortably consumed directly from the container 10 and precludes tip-over of the container even when the mug 12 has no beverage therein and thus exerts only a minimum stabilizing effect. The proper location of point 80 also prevents the lid 30 from simply falling rearwardly, without restraint, and thus insures that the still partially elevated lid 30 can easily be returned to its top-closed orientation simply by nudging the top surface thereof with the same thumb used to work the lid lever 34.

Alternatively, but preferably in addition thereto (as illustrated in the FIG. 3), the handle 20 defines an outrigger rest 82. The outrigger rest 82 is disposed in the same plane as the container bottom 16 (either exactly or slightly thereabove) and outwardly beyond a vertical axis through the pivot axis 36 of the lid 30 relative to the securing means 40. Preferably the outrigger rest 82 will extend outwardly from the mug 12 as far the handle 20. The outrigger rest 82 has the effect of increasing the effective diameter of the mug 12 for the purpose of preventing tipping over of the mug 12 because of the weight of the lid body 32 in the top-open position. In other words, the outrigger rest 82 defines a new potential pivot axis for toppling over of the container 10, thereby allowing the weight of all of the container to the other side thereof (including handle 20 and any beverage in the mug 12) to act as. ballast working against toppling of the container 10.

The mug 12 is preferably formed of crystal high impact polystyrene. The handle 20 may be of the same material and may be molded in the same operation integrally with the mug 12. Alternatively, the handle 20 may be of a different material, such as high impact polystyrene, molded separately from the mug 12 and thereafter secured thereto by adhesive bonding, thermal bonding or the like. For example, the opposed ends of the handle 20 may be adhesively secured to the sidewall 18 of mug 12 by means of methyl-ethyl ketone (MEK) cement. The securing means 40 is preferably a resilient acrylonitrile-butadiene-styrene (ABS) plastic. The rigid lid is preferably also ABS.

In a much preferred embodiment of the present invention, the container 10 additionally includes a three-dimensional character 90 secured to the lid 30, and in particular the upper surface of the lid body 32. The character is illustrated in FIGS. 1 and 2 as a frog (sitting on the lid body 32), but clearly other characters, objects, portions thereof and the like may be used. If desired, the three-dimensional character may be replaced by a two-dimensional representation thereof—e.g., a drawing or photograph of the character secured to the lid body, such as on a label. The character 90 is preferably oriented relative to the lid body 32 such that it is adjacent the upwardly-facing speaker 76 and the sounds emerging from the small apertures 78 appear to come from the mouth or other presumed sound-producing element of the character 90.

The three-dimensional character 90 is preferably molded polyvinyl chloride (PVC). Because PVC does not adhere well to the ABS material forming the lid 30, an intermediate piece 92 may be employed. The piece 92 is illustrated as cylindrical in configuration (but with a key). The piece 92 is secured to the top surface of the lid body 32 by adhesive means, thermal bonding, a screw, or the like and is received by the character 90 in a recess (and keyway) in the bottom surface thereof, optionally with adhesive.

For the frog character 90, the sound-generating element 50 might produce a "gribbet" sound whenever the actuation button 54 was depressed, regardless of whether or not it was depressed sufficiently to also pivot the lid 30 out of the top-closed orientation. For other characters, the sound-generating element 50 may produce appropriate sounds—e.g., a "quack" for a duck character 90. An advertising slogan, hopefully appropriate for the character, may also be produced by the sound-generating element 50.

To summarize, the present invention provides a drinking container which is exciting to use and encourages drinking therefrom because it automatically generates sounds when the user moves the lid to the open orientation, although in a preferred embodiment the sound may also be generated without movement of the lid to the open orientation. The container is stable and won't topple even when it is empty and the lid is in the open orientation. In a preferred embodiment a character is secured to the lid for movement therewith and appears to generate sound whenever the lid is moved to the open orientation and sometimes even without movement of the lid.

Now that the preferred embodiments of the present invention have been shown and described in detail, various modifications and improvements thereon will become readily apparent to those skilled in the art. Accordingly, the present invention is to be construed broadly and limited only by the appended claims, and not by the foregoing specification.

We claim:

1. A drinking container comprising:

(A) a fluid-tight container having an open top, a closed bottom, a continuous sidewall connecting said top and bottom, and a handle secured to said sidewall and extending substantially the length of said sidewall;

(B) a rigid lid having a lid body configured and dimensioned to close said open top and a lid lever extending outwardly from said lid body and beyond said handle for pivoting said lid body relative to said open top from a top-closed orientation to a top-open orientation;

(C) means for pivotally securing together said handle and said lid lever so as to enable pivoting of said lid body between said top-closed orientation and said top-open orientation; and (D) an electronic sound-generating element disposed in said lid body and responsive to an actuating switch disposed on said lid lever such that the normal movement of a user for causing pivoting of said lid body from said top-closed orientation to said top-open orientation also actuates said sound-generating element prior to causing pivoting of said lid body.

2. The container of claim 1 wherein said lid and said sound-generating element are removable from said container and said securing means, thereby to permit cleaning of the latter.

3. The container of claim 1 wherein said lid body has a fluid-tight compartment housing a power source and said sound-generating element.

4. The container of claim 1 wherein said lid lever has disposed therein an actuating switch extending upwardly therefrom for actuation of said sound-generating element.

5. The container of claim 1 wherein said actuating switch is manually actuable without pivoting of said lid body from the top-closed orientation.

6. The container of claim 1 wherein said lid lever and said handle by abutment limit said top-open orientation to an orientation in which said container, even when empty, will normally remain upright on said container bottom.

7. The container of claim 1 wherein said handle defines an outrigger rest disposed in the same plane as said container bottom and outwardly beyond a vertical axis through the pivot axis of said lid relative to said securing means.

8. The container of claim 7 wherein said lid lever and said handle by abutment limit said top-open orientation to one in which said container, even when empty, will normally remain upright on said container bottom and said outrigger rest.

9. The container of claim 1 additionally including:

(E) a character secured to the top of said lid body for movement therewith.

10. The container of claim 9 wherein said container is crystal high impact polystyrene, said lid and said securing means are resilient ABS (acrylonitrile-butadine-styrene), and said character is molded PVC (polyvinyl chloride).

11. The container of claim 9 including in said lid an upwardly-facing speaker disposed adjacent said character and actuated by said sound-generating element.

12. A drinking container comprising:

(A) a fluid-tight container having an open top, a closed bottom, a continuous sidewall connecting said top and bottom, and a handle secured to said sidewall and extending substantially the length of said sidewall;

(B) a rigid lid having a lid body configured and dimensioned to close said open top and a lid lever extending outwardly from said lid body and beyond said handle for pivoting said lid body relative to said open top from a top-closed orientation to a top-open orientation;

(C) means secured to said handle for pivotally engaging said lid lever and enabling pivoting of said lid body between said top-closed orientation and said top-open orientation; and (D) an electronic sound-generating element disposed in said lid body and responsive to an actuating switch disposed on said lid lever such that the normal movement of a user for causing pivoting of said lid body from said top-closed orientation to said top-open orientation also actuates said sound-generating element prior to causing pivoting of said lid body;

said lid body having a fluid-tight compartment housing a power source and said sound-generating element, said lid and said sound-generating element being removable from said fluid-tight container and said securing means, thereby to permit cleaning of the latter;

said lid lever having disposed therein an actuating switch extending upwardly therefrom for actuation of said sound-generating element, said actuating switch being manually actuable without pivoting of said lid body from the top-closed orientation.

13. The container of claim 12 additionally including:

(E) a character secured to the top of said lid body for movement therewith; and (F) an upwardly-facing speaker disposed in said lid body adjacent said character and actuated by said sound-generating element;

said handle defining an outrigger rest disposed in the same plane as said container bottom and outwardly beyond a vertical axis through the pivot axis of said lid relative to said securing means;

said lid lever and said handle by abutment limiting said top-open orientation to one in which said container, even when empty, will normally remain upright on said container bottom and said outrigger rest.

* * * * *